US006254704B1

(12) United States Patent
Laul et al.

(10) Patent No.: US 6,254,704 B1
(45) Date of Patent: Jul. 3, 2001

(54) METHOD FOR PREPARING A THERMAL SPRAY POWDER OF CHROMIUM CARBIDE AND NICKEL CHROMIUM

(75) Inventors: Komal Laul, East Meadow; Mitchell R. Dorfman, Smithtown, both of NY (US); Ronald Eugene Somoskey, Jr., Ortonville, MI (US)

(73) Assignee: Sulzer Metco (US) Inc., Westbury, NY (US)

( * ) Notice: Subject to any disclaimer, the term of this patent is extended or adjusted under 35 U.S.C. 154(b) by 0 days.

(21) Appl. No.: 09/492,501

(22) Filed: Jan. 27, 2000

Related U.S. Application Data

(63) Continuation of application No. 09/086,243, filed on May 28, 1998, now Pat. No. 6,071,324.

(51) Int. Cl.[7] ..... C22F 1/00
(52) U.S. Cl. ..... 148/513
(58) Field of Search ..... 148/513

(56) References Cited

U.S. PATENT DOCUMENTS 3,846,084 * 11/1974 Pelton .
3,881,910 * 5/1975 Pelton .
4,606,948 * 8/1986 Hajmrle et al. ..... 427/423
4,865,252 * 9/1989 Rotolico et al. .
5,098,748 * 3/1992 Shimizu et al. ..... 427/423
5,126,104 * 6/1992 Anand et al. ..... 419/12
5,137,422 * 8/1992 Price et al. ..... 415/200
5,747,163 * 5/1998 Douglas ..... 428/404
5,863,618 * 1/1999 Jarosinski et al. ..... 427/450

FOREIGN PATENT DOCUMENTS 0 834 585 A1 * 4/1998 (EP) .

OTHER PUBLICATIONS

L. Russo and Dorfmann, "A Structural Evaluation of HVOF Sprayed NiCr–Cr3C2 Coatings", Proceedings of Thermal Spraying, May 22–26, 1995, Kobe, Japan (High Temp. Soc. of Japan).*

Brochure– "Cat Powders– Introducing a Whole New Breed of CrC–NiCr Powder Technology", Praxair Surface Technologies (undated).*

Reardon, J.D. et al: "Plasma– and Vacuum—Plasma–Sprayed chromium carbide composite coatings", Thin Solid Films (1981) pp. 345–351.*

Mor, F. et al: "Tribological behavior of different HVOF spray cartridge". Adv. Powder Metall Part Matter (1996) (vol. 5) pp. 18/55–18/68.*

* cited by examiner

*Primary Examiner*—Ngoclan Mai
(74) *Attorney, Agent, or Firm*—Ira J. Schaefer, Esq.

(57) ABSTRACT

A thermal spray powder consists of nickel, chromium and carbon. The chromium consists of a first portion and a second portion, the nickel being alloyed with the first portion in an alloy matrix. The second portion and the carbon are combined into chromium carbide substantially as $Cr_3C_2$ or $Cr_7C_3$ or a combination thereof, with the chromium carbide being in the form of precipitates between 0.1 $\mu$m and 5 $\mu$m distributed uniformly in the alloy matrix.

4 Claims, 1 Drawing Sheet

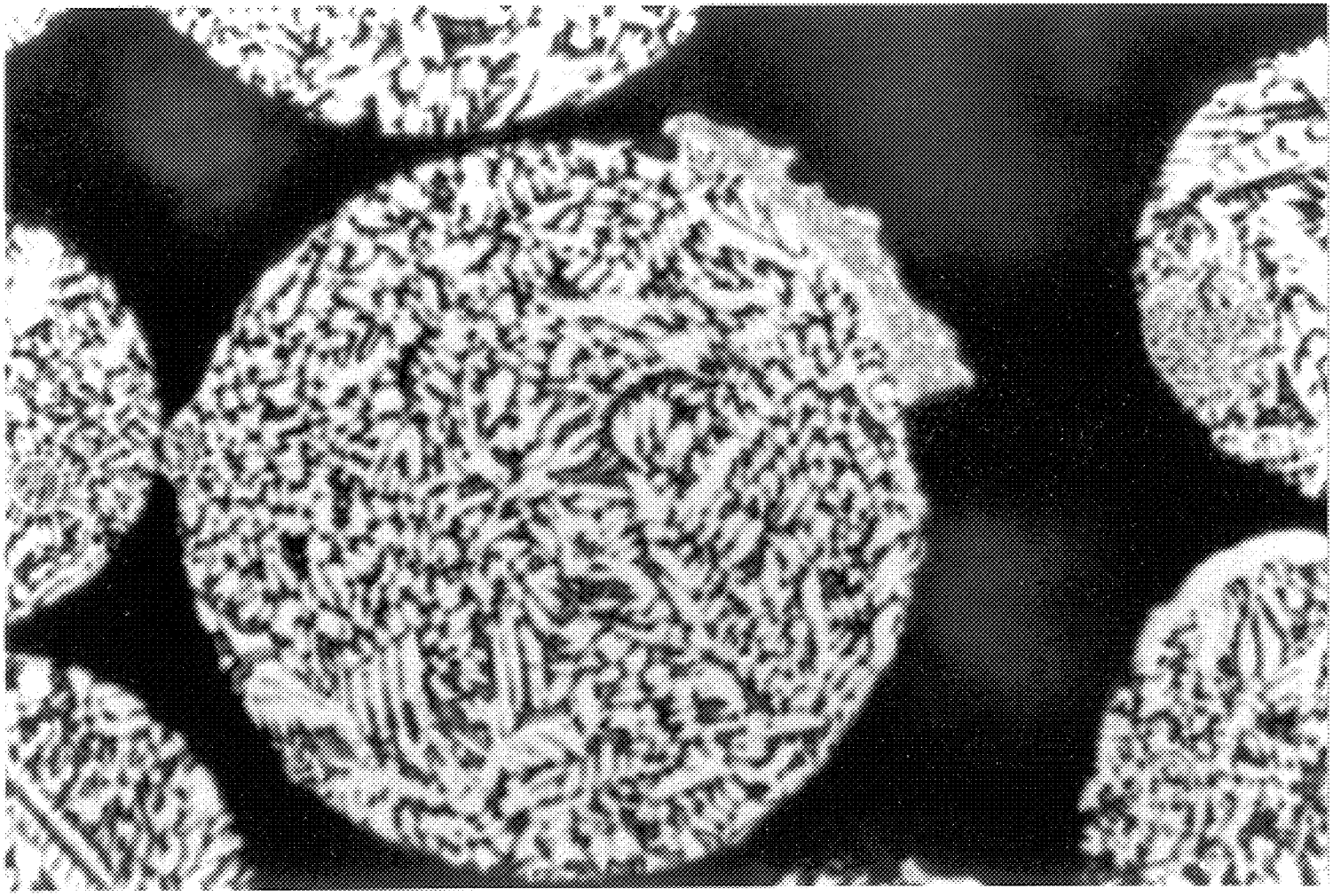

METHOD FOR PREPARING A THERMAL SPRAY POWDER OF CHROMIUM CARBIDE AND NICKEL CHROMIUM

This application is a continuation of application Ser. No. 09/086,243 filed May 28, 1998, now U.S. Pat. No. 6,071,324.

This invention relates to thermal spray powders of chromium carbide and nickel chromium alloy.

BACKGROUND

Thermal spraying, also known as flame spraying, involves the melting or at least heat softening of a heat fusible material such as a metal or ceramic, and propelling the softened material in particulate form against a surface which is to be coated. The heated particles strike the surface where they are quenched and bonded thereto. In a plasma type of thermal spray gun, a high temperature stream of plasma gas heated by an arc is used to melt and propel powder particles. Other types of thermal spray guns include a combustion spray gun in which powder is entrained and heated in a combustion flame, such as a high velocity, oxygen-fuel (HVOF) gun.

One type of thermal spray powder is formed of chromium carbide and nickel chromium alloy. The carbide does not melt well and would be too brittle alone in a coating, so the alloy, typically nickel with 20% by weight chromium, is incorporated in each powder particle to provide a matrix. Chromium carbide and nickel chromium alloy are selected for high temperature, corrosive and oxidizing environments such as in a gas turbine engine, up to about 815° C.

There are three forms of chromium carbide, $Cr_3C_2$, $Cr_7C_3$ and $Cr_{23}C_6$ according to a standard phase diagram. The first, $Cr_3C_2$, is most wear resistant and stable, melting at 1811° C. The second melts at 1766° C. The third, $Cr_{23}C_6$, is least wear resistant and stable, melting at 1576° C. The first and second form have orthorhombic structure, and the third form is cubic.

Present commercially available powders of chromium carbide with nickel-chromium commonly are produced by blending, or by chemical or mechanical cladding of the alloy onto grains of the carbide, or by mixing, sintering and crushing. Such methods are relatively expensive and effect particles with relatively large grains of carbide. During spraying these grains are exposed to oxidizing conditions which decarborize the carbide and introduce oxides into the coatings. Also the larger grains in coatings can cause scuffing of mating surfaces.

A group of chromium carbide powders were introduced recently by Praxair Surface Technologies, Indianapolis, Ind., according to a brochure "CAT Powders—Introducing A Whole New Breed of CrC—NiCr Powder Technology" (undated). These are CRC-410 (70CrC-30 NiCr), CRC-425 (60CrC-40 NiCr) and CRC-415 (35CrC-65 NiCr). The present inventors obtained an x-ray diffraction analysis of these powders which showed the carbide to be in the form of $Cr_{23}C_6$, and a chemical analysis which determined a ratio (by weight) of chromium to carbon in the powders to be 22.2 for powders designated CRC-410-1 and CRC-425-1, and 37.6 for CRC-415-1.

SUMMARY

An object of the invention is to provide a novel thermal spray powder of chromium carbide and nickel-chromium, the powder having reduced cost and producing thermal sprayed coatings having high temperature properties comparable to or better than coatings from conventional powders of similar composition.

The foregoing and other objects are achieved by a thermal spray powder having a size essentially between 10 μm and 125 μm, with each powder particle consisting essentially of nickel, chromium and carbon. The chromium consists of a first portion and a second portion, the nickel being alloyed with the first portion in an alloy matrix. The second portion and the carbon are combined into chromium carbide substantially as $Cr_3C_2$ or $Cr_7C_3$ or a combination thereof, with the chromium carbide being in the form of precipitates essentially between 0.1 μm and 5 μm distributed substantially uniformly in the alloy matrix. The chromium should have a ratio by weight to the carbon between 6 and 12.

BRIEF DESCRIPTION OF THE DRAWING

The drawing is a photograph of a metallographic cross section of powder particles of the invention.

DETAILED DESCRIPTION

A thermal spray powder according to the invention has a size distribution within a range essentially between 10 μm and 125 μm, the size distribution being selected according to type of thermal spray process used for effecting a coating. For example, for a plasma gun with higher velocity spray a size distribution of 44 μm to 125 μm is suitable, or for a plasma gun with lower velocity spray) a size of 10 μm to 53 μm is suitable, or for an HVOF gun a size of 16 μm to 44 μm is suitable.

Each powder particle consists essentially of nickel, chromium and carbon. Typical powder particles are shown in the cross sectional photomicrograph. (The central particle is about 40 μm diameter.) A matrix phase (darker grey) is a nickel-chromium alloy. Precipitates (lighter grey) are formed of chromium carbide substantially as $Cr_3C_2$ or $Cr_7C_3$ or a combination thereof. The alloy preferably is nominally 80:20 nickel to chromium but may contain more chromium to the extent that chromium is taken from the carbide. The proportion of nickel in the alloy is not critical to the invention and may be modified to enhance coating properties, for example 50:50 Ni:Cr alloy for special corrosive conditions (e.g. from fuel oil contaminants or additives). (All percentages and ratios set forth herein and in the claims are by weight except for atomic proportions in the chemical formulae for the carbide.)

Thus the chromium consists of a first portion and a second portion, the first portion being alloyed with the nickel, and the second portion being combined with carbon in the carbide. The nickel should be between about 10% and 90% of the total of the nickel, chromium and carbon. With such composition, the powder is for producing thermal sprayed coatings having the elevated temperature wear resistance of the designated chromium carbides, and the oxidation and corrosion resistance of nickel-chromium alloy.

The carbide precipitates generally have a size of approximately 1 μm, essentially between 0.1 μm and 5 μm, and are distributed substantially uniformly in the alloy matrix. (This size is average cross-sectional diameter of the dendritic precipitates which may be elongated.)

To achieve this structure the powder should be formed by rapid solidification from a melt, preferably by conventional atomization, and more preferably by inert gas atomization. Air or water may used but would introduce oxides into the powder. Such production of the powder is by atomizing from a melt of the constituents nickel, chromium and carbon at about 1600° C. for the lowest carbon content to 1460° C. for the highest carbon content. Preferably the atomizing is with inert aspirating gas such as argon in a closed coupled gas atomization system. For example, the melt flows by gravity through an annular delivery tube with an annular opening of about 1.0 to 2.0 mm on a 2.4 cm diameter circle, and is atomized by choked flow from an annular nozzle of about 0.3 to 0.5 mm on a 3.0 cm diameter circle concentric with the delivery tube to cause aspirating conditions at the tip of the delivery tube to aid in atomization. The atomizing gas pressures are varied from 2.76 MPag (400 psig) for the lowest carbon content to 3.45 MPag (500 psig), flows are 212 to 236 sl/sec (450 to 500 scfm).

Other conventional or other desired configurations for the atomizing may be used, such as a non-aspirating, gravity flow atomizing nozzle system. Other powder production techniques for rapid solidification may be used, such as centrifugal with rotating disk or rotating electrode.

Also, one or more other elements may be added to enhance production or powder properties or coating properties, such as 1% to 5% manganese (e.g. 2% or 4%) to enhance manufacturability. However, the additive should not interfere significantly with the presence of $Cr_3C_2$ and $Cr_7C_3$ or significantly lower the melting point of the powder.

Table 1 shows several compositions over a range encompassed by the invention. These were produced for testing (except No. 1). The column "Ratio Cr:C" indicates the ratio of total chromium to carbon in the powder. It may be seen that the ratios are relatively low in a range between 6.5:1 and 10:1, i.e. within a more broadly defined range of 6 and 12.

TABLE 1

| Powders | | | | |
|---|---|---|---|---|
| No. | Ni (%) | Cr (%) | C (%) | Ratio Cr:C |
| 1 | 64 | 33.3 | 2.7 | 12:1 |
| 2 | 56 | 40 | 4 | 10:1 |
| 3 | 40 | 53.3 | 6.67 | 8:1 |
| 3A | | (No. 3 heat treated)* | | |
| 4 | 20 | 70 | 10 | 7:1 |
| 5 | 19.2 | 67.2 | 9.6** | 7:1 |
| 10 | 85 | 13 | 2 | 6.5:1 |

* In nitrogen at 1038° C. for 20 minutes.
** Plus 4% manganese.

X-ray diffraction analysis of the powders in the table qualitatively showed the carbide to be substantially $Cr_3C_2$ and $Cr_7C_3$. A free carbon analysis showed a small trace (less than 0.1k) of free carbon. The highest desirable ratio of Cr:C is 12, and lowest is 6.5. A significantly higher Cr:C ratio should be avoided as this is expected to yield a carbide containing a significant amount of $Cr_{23}C_6$. The nickel is provided for corrosion resistance and matrix purposes and, as it does not form a carbide, its relative content should not significantly affect the formation or type of chromium carbide. The photograph shows the No. 3 powder.

A portion of the No. 3 composition (No. 3A) was heat treated in nitrogen at 1038° C. (1900° F.) for 20 minutes. This increased the proportion of $Cr_3C_2$ in the powder.

The powders in size 16 to 44 μm were sprayed with a Metco™ type DJ HVOF thermal spray gun of a type described in U.S. Pat. No. 4,865,252, using a DJ2603 nozzle and the following parameters: hydrogen combustion gas at %7 MPag (140 psig) pressure and 231 sl/min (489 scfh) flow rate, oxygen at 1.17 ,MPag (170 psig) and 685 sl/min (1450 scfh) flow, 1.8 to 2.2 kg/hr (4–5 lb/hr) spray rate, 22.5 cm spray distance, 75 cm/min traverse rate, coating thickness 0.1 to 0.5 mm. Dense, high quality coatings were obtained on mild steel prepared by grit blasting with −60 mesh alumina grit, with low porosity (less than 5%) and good substrate bonding.

Table 2 shows test results of hardness (Vickers hardness number VHN) and slurry wear using a conventional wear test with an aqueous slurry of alumina with a size of 11 μm to 45 μm, for a coating specimen sliding with the slurry against a mild steel plate for two 10-minute runs. "Slurry Wear" is weight loss in grams, and "Depth of Wear", is measured thickness loss in millimeters. For comparison, Diamalloy™ 3007 (sold by Sulzer Metco) is a conventional powder of $Cr_3C_2$ clad with 20% Ni-20Cr and having size 5.5 μm to 44 μm; this powder has large grains of chromium carbide ($Cr_3C_2$) in each powder particle, generally of size about 25 μm.

TABLE 2

| Coatings | | | |
|---|---|---|---|
| Powder No. | Hardness (VHN) | Slurry Wear | Depth of Wear |
| 1 | 675 | | |
| 2 | 870 | 1.5 | 0.14 |
| 3 | 1060 | 0.6 | 0.09 |
| 5 | 975 | 0.53 | 0.085 |
| Diamalloy 3007 | 1000 | 0.35 | 0.05 |

Powders of the invention may be mixed with other powder compositions. Specific mixtures were prepared with by mixing the No. 3 composition with other powders designated in Table 3. The other powders are conventional: Diamalloy 4006 is nickel alloy containing 20 Cr, 10 W, 9 Mo and 4 Cu, size 11 to 53 μm; Diamalloy 1006 is nickel alloy containing 19 Cr, 18 Fe, 3 Mo, size 11 to 45 μm; Metco™ 70F-NS is crushed $Cr_3C_2$, size 5 to 45 μm; and Metco 43F is nickel alloy containing 20 Cr, size 11–53 μm. Table 3 shows such blends. (Powder set forth in the claims may be a blend comprising such additional powders.)

TABLE 3

| Mixtures | | | | |
|---|---|---|---|---|
| Powder No. | Component A | % A | Component B | % B |
| 6 | No. 3 | 75% | 4006 | 25% |
| 7 | No. 3 | 80% | 1006 | 20% |
| 8 | No. 3 | 85% | 73F-NS | 15% |
| 9 | No. 3 | 80% | 43F | 20% |

These mixtures were thermal sprayed with the same type of gun and spray parameters as described above. Coatings were finished by grinding using a 150 grit diamond wheel. Deposit efficiency, percentage of carbon in the coating, macro-hardness (Rockwell C-Rc), micro-hardness (DPH Vickers, 300 gram load) and ground surface finish were measured. Table 4 shows results compared with conventional coatings Diamalloy 3007 (described above) and 3004 which is a blend of $Cr_3C_2$ with 25% nickel 20% chromium alloy of size 5.5 to 45 μm. These conventional powders are of generally similar composition but with larger carbide grains, and were sprayed with the gun and parameters set forth above.

TABLE 4

| | Results | | | | |
|---|---|---|---|---|---|
| Powder No. | Dep. Eff. | % C | Rc | DPH | Finish ($\mu$m) |
| 3 | 65-70% | 6.2% | 64 | 1060 | 0.41 |
| 8 | 55–60% | 6.3% | 64 | 1060 | 0.38 |
| 7 | 50–55% | 5.1% | 60 | 880 | 0.38 |
| 6 | 50–55% | 4.5% | 62 | 900 | 0.36 |
| 9 | 50–55% | 5.0% | 61 | 930 | 0.33 |
| 3004 | 40–45% | 3.4% | 64 | 990 | 0.41 |
| 3007 | 40–45% | 6.4% | 66 | 1000 | 0.41 |

In the conventional coatings of 3004 and 3007 the size of the carbides is substantially the size of the carbide grains in the powder which is about 5 to 53 $\mu$m. The carbides in the coatings produced from the powders of the invention are in the 1 micron range. Presence of carbide (primarily $Cr_7C_3$) in the coating from the No. 3 powder was confirmed by x-ray diffraction analysis. The fine carbide grain size should provide benefits of low scuffing of mating surfaces with improved sliding wear, and less particle pullout. Also, there was high carbon retention of about 80% compared with 35% to 65% in conventional chromium carbide coatings of similar composition, and relatively low oxygen content. The high carbon and low oxygen reflect reduced oxidation during spraying.

Deposit efficiency for the present powders is higher than for the conventional powders of similar composition. Thus not only is the powder itself lower in cost by way of the manufacturing method (atomization), but coating costs are even less due to the deposition efficiency. Carbon retention, hardnesses and finishes may be seen to be comparable to or better than the conventional coatings.

Other types of powders may be mixed with the chromium carbide powder of the invention to attain other properties. An example is a powder of nickel clad onto 20% graphite of size 30 to 90 $\mu$m.

While the invention has been described above in detail with reference to specific embodiments, various changes and modifications which fall within the spirit of the invention and scope of the appended claims will become apparent to those skilled in this art. Therefore, the invention is intended only to be limited by the appended claims or their equivalents.

What is claimed is:

1. A method for preparing a thermal spray powder comprising:

providing powder particles each consisting essentially of nickel, chromium and carbon, the chromium consisting of a first portion and a second portion, the nickel being alloyed with the first portion in an alloy matrix, the second portion and the carbon being combined into chromium carbide substantially as $Cr_3C_2$ or $Cr_7C_3$ or a combination thereof, and the chromium carbide being in the form of precipitates essentially between 0.1 $\mu$m and 5 $\mu$m distributed substantially uniformly in the alloy matrix; and heat treating said particles to increase the proportion of $Cr_3C_2$ in the powder.

2. The method of claim 1, wherein the heat treating step takes place in the presence of nitrogen.

3. The method of claim 2, wherein the heat treating step takes place at 1900° F.

4. The method of claim 3, wherein the heat treating step takes place for 20 minutes.

* * * * *